US007059076B2

(12) United States Patent
Stoner et al.

(10) Patent No.: US 7,059,076 B2
(45) Date of Patent: Jun. 13, 2006

(54) FIREARM RAIL SYSTEM

(75) Inventors: Matthew J Stoner, Tucson, AZ (US); Cade L. Wilson, Tucson, AZ (US); Gustavo T. Palacios, Tucson, AZ (US); Jeffrey W. Henderson, Tucson, AZ (US); Gregg T. Mott, Tucson, AZ (US)

(73) Assignee: Abrahms Airborne Manufacturing, Tucson, AZ (US)

( * ) Notice: Subject to any disclaimer, the term of this patent is extended or adjusted under 35 U.S.C. 154(b) by 0 days.

(21) Appl. No.: 10/877,426

(22) Filed: Jun. 25, 2004

(65) Prior Publication Data

US 2006/0010748 A1 Jan. 19, 2006

(51) Int. Cl.
*F41A 21/48* (2006.01)

(52) U.S. Cl. ..... 42/75.01; 42/75.02; 42/96

(58) Field of Classification Search ..... 42/75.01, 42/75.02, 75.04, 96
See application file for complete search history.

(56) References Cited

U.S. PATENT DOCUMENTS

| | | | | |
|---|---|---|---|---|
| 3,276,377 | A | 10/1966 | Bell | |
| 3,611,606 | A | 10/1971 | Sefreid et al. | |
| 3,648,953 | A | 3/1972 | Polk, Jr. | |
| 4,027,414 | A | 6/1977 | Felix | |
| 4,085,511 | A | 4/1978 | Kovac | |
| 4,205,473 | A | 6/1980 | Wilson | |
| 4,249,315 | A | 2/1981 | Hopson, III | |
| 4,722,496 | A | 2/1988 | Herrmann et al. | |
| 4,742,636 | A | 5/1988 | Swan | |
| 4,845,871 | A | 7/1989 | Swan | |
| 5,062,346 | A | 11/1991 | Greve Hansen et al. | |
| 5,097,614 | A | 3/1992 | Strong | |
| 5,123,329 | A | 6/1992 | Irwin | |
| 5,142,806 | A | 9/1992 | Swan | |
| 5,276,988 | A | 1/1994 | Swan | |
| 5,343,650 | A | 9/1994 | Swan | |
| 5,590,484 | A * | 1/1997 | Mooney et al. | 42/111 |
| 6,490,822 | B1 | 12/2002 | Swan | |
| 6,499,245 | B1 | 12/2002 | Swan | |
| 6,792,711 | B1 * | 9/2004 | Battaglia | 42/114 |
| 6,854,206 | B1 * | 2/2005 | Oz | 42/124 |

OTHER PUBLICATIONS

"Military Standard, Dimensioning of Accessory Mounting Rail for Small Arms Weapons", MIL STD-1913 (AR) , Feb. 3, 1995; 10 pages.
"Military Standard, Dimensioning of Accessory Mounting Rail for Small Arms Weapons", MIL-STD-1913, Notice 1, Jun. 10, 1999; 2 pages.

(Continued)

*Primary Examiner*—Stephen M. Johnson
(74) *Attorney, Agent, or Firm*—Mark Ogram

(57) ABSTRACT

An attachment for a firearm having a barrel with a barrel nut mechanism located around an aft portion of said barrel. The attachment includes a shield or supplemental mechanism which is positioned close to the barrel. An attachment mechanism having a first and second claw diametrically opposed to each other, are positioned to be accepted by the barrel nut mechanism secured to the barrel. In the preferred embodiment, the attachment completely encircles the barrel using an upper portion and a lower portion which is swivelly connected to said attachment mechanism at a first end and a locking mechanism securable to the upper portion of the barrel handguard.

17 Claims, 5 Drawing Sheets

OTHER PUBLICATIONS

"Army TM 9-1005 319 23& P", Air Force to 1 1W3 5-5 42 ;6 pages; no date.
"AR-15, CAR-15, M16"; pp. 74-84; no date.
"AR-15, CAR-15, M16" (diagrams); pp. 65-74; no date.
"MIL-R-63997 (AR), Amendment 4, Jul. 31, 1993", Superseding Amendment 3, Mar. 25, 1992 ; 66 pages.

* cited by examiner

FIREARM RAIL SYSTEM

BACKGROUND OF THE INVENTION

This invention relates generally to small arms and more particularly to a mechanism used to isolate and protect the barrel of a firearm.

The modern firearm, while still relatively simple, has evolved to utilize a great deal of accessories so that the weapon, and its user, are able to address unique situations. No longer is the simple addition of a sighting scope sufficient; the modern weapon requires a mounting surface for such items as: grenade launchers; night scopes; secondary weapons; and a host of other items. Often, these weapons are not equipped with the proper mounts.

Further, the modem weapon is designed to fire at such a rate that the barrel of the weapon becomes extremely hot; thereby creating a hazard for the user. To protect the user, a guard is often mounted around the barrel to keep the user from grasping the barrel. This guard though often becomes hot due to the convection of heat from the barrel through the mounts holding the guard.

To all of this is the added attribute that any mechanism mounted on the firearm be easily removed so that it can be cleaned and repaired when needed.

It is clear there is a need for an improved small arms rail system.

SUMMARY OF THE INVENTION

The invention includes an attachment for a firearm having a barrel with a barrel nut mechanism located around an aft portion of said barrel. In this context, the barrel nut mechanism is operated by sliding a retainer slip-ring back, thereby exposing an engagement mechanism configured to accept mating claws. When the retainer slip-ring is released, the claws/engagement mechanism are secured to each other.

Those of ordinary skill in the art recognize that one such barrel nut mechanism is the "barrel nut and slip-ring" found on the M-16 rifle and which is described in MIL-R-63997B (AR) Amendment 4, 31 Jul. 1993, incorporated hereinto by reference.

Within the present discussion, the attachment which is being mounted onto the firearm is a shield to protect the user from contacting the barrel. Those of ordinary skill in the art recognize other attachments which are useful in this context.

The completed shield is positioned around the barrel but is isolated from the barrel to keep heat transfer to a minimum. The shield often has numerous openings to allow ambient air to flow around the barrel and assist in keeping the barrel from overheating.

In the preferred embodiment, the shield is composed of two major parts: an upper portion and a lower portion.

At one end of the upper portion are positioned a first and second claw, forming the attachment mechanism. In the preferred embodiment, the claws are diametrically opposed to each other and are ideally positioned substantially parallel to a horizontal axis of the barrel.

The claws provide a mechanism for attaching the upper portion to the barrel nut mechanism secured to the barrel. The outer slip-ring of the barrel nut mechanism is withdrawn; the claws are positioned; and the slip-ring is engaged so to affix the upper portion (via the claws) to the barrel nut mechanism.

In the preferred embodiment, while the upper portion is secured to the barrel via the barrel nut mechanism, a "rail" secured to the upper side of the upper portion of the shield is connected to the firearm using a MIL standard 1913, also known as a "picatinny rail system". Once such rail is described in U.S. Pat. No. 6,490,822, entitled "Modular Sleeve" issued on Dec. 10, 2002, to Swan, incorporated hereinto by reference.

Once the top portion of the shield is secured to the weapon, the lower portion is then secured to the upper portion. In the preferred embodiment, the lower portion is first secured to a pivot or swivel connection at a rear end of the upper portion. This swivel connection is created by engaging two notches on the lower portion with two pins on the upper portion (the reverse arrangement is also acceptable).

Once swivelly engaged with pins on the upper portion, the forward section of the lower portion of the barrel handguard is "snapped" engaged with the upper portion of the barrel handguard. This task is accomplished using two spring clips mounted on the lower portion which engage slots on the upper portion of the barrel handguard. In an alternative embodiment, the springs are mounted on the upper portion and the slots are located on the lower portion of the barrel handguard.

Once engaged as outlined above, the shield completely encircles the barrel and is secured to the firearm at the barrel nut and the attachment rail.

The shield of the preferred embodiment also contains a variety of mounting mechanisms permitting other attachments to be secured to the shield; and, the upper rail itself is configured to accept a variety of items including: a sighting scope; laser sights; and a host of other items.

Because of the simplicity of design, the shield is easily removed in the field and requires only a minimum of tools (a screwdriver, a hex key wrench, or a coin for securing the rail to the top of the firearm). This permits the firearm to be easily repaired or cleaned. Further, the firearm is easily "customized" for a specific operation without requiring extensive tooling or labor.

The invention, together with various embodiments thereof will be more fully explained by the accompanying drawings and the following description thereof.

DRAWINGS IN SUMMARY

Figure 4A:
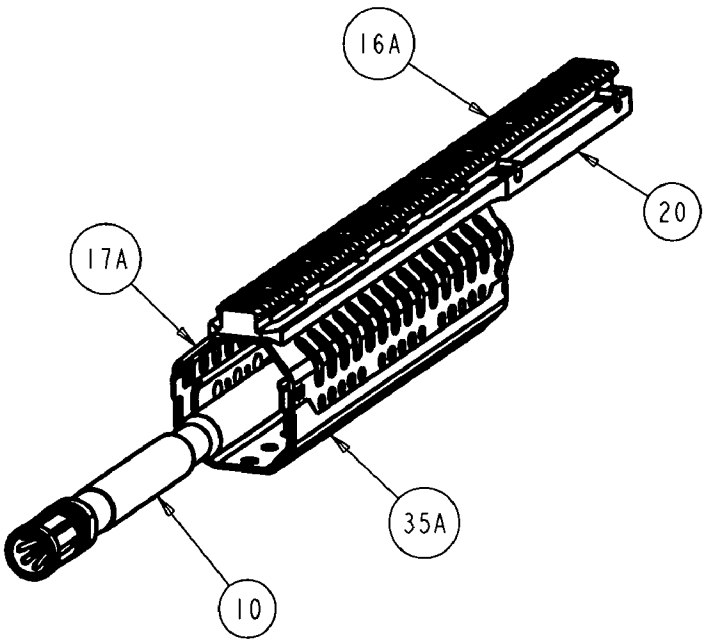

FIG. 4*a* is a front perspective of the fully assembled shield of the preferred embodiment encircling the barrel.

Figure 4B:
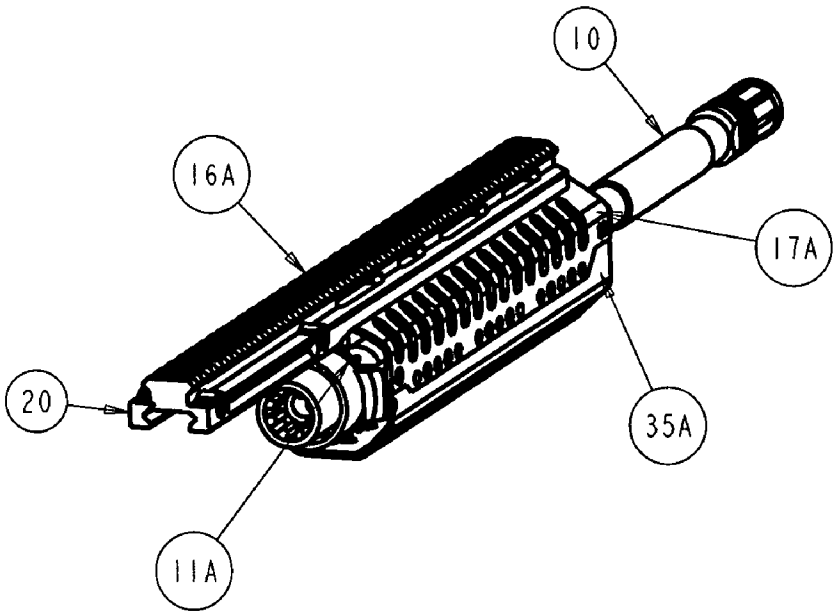

FIG. 4B is a rear perspective of the fully assembled shield of the preferred embodiment encircling the barrel.

DRAWINGS IN DETAIL

Figure 1:
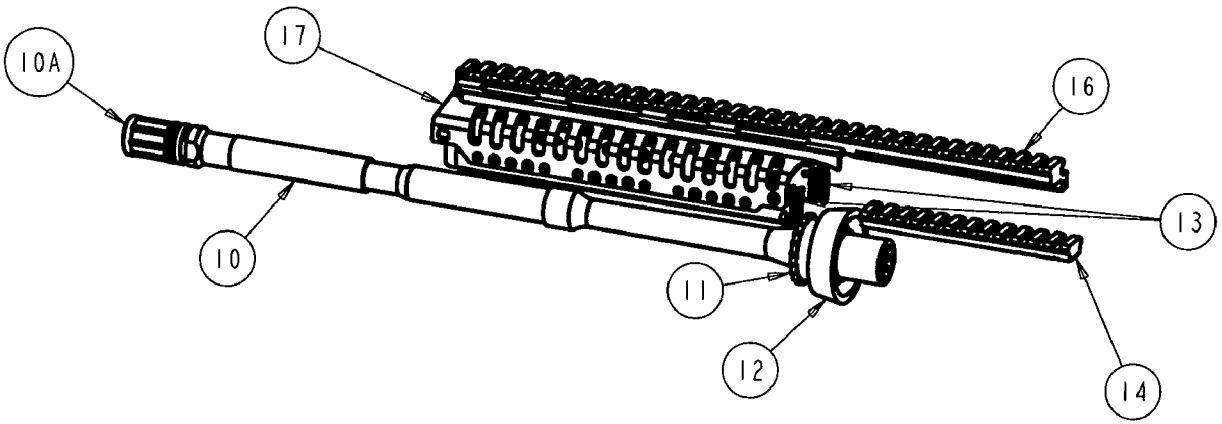
FIG. 1 is a side view of the preferred embodiment's upper portion of the shield prior to engaging the barrel nut.

FIG. 1 is a side view of the preferred embodiment's upper portion of the shield prior to engaging the barrel nut.

Barrel 10 has as its forward end 10A with a locking nut 11 at a rearward end. In this illustration, slip-ring 12 has been pulled back on barrel nut 11. This places barrel nut 11 in position to accept claws 13. Claws 13 are located on an upper portion 17 of the shield. Also, note, claws 13 are placed in a diametrically opposed positions so that optimal engagement is 1obtained with barrel nut 11.

Once claws 13 are engaged with barrel nut 11, this places upper rail 16 over receiver rail 14. Receiver rail 14 is part of the upper portion of the firearm's action (not shown for simplicity). Rail 16 is configured with a picatinny to engage with receiver rail 14.

Slip-ring 12 is moved forward to capture claws 13 within barrel nut 11.

Figure 2:
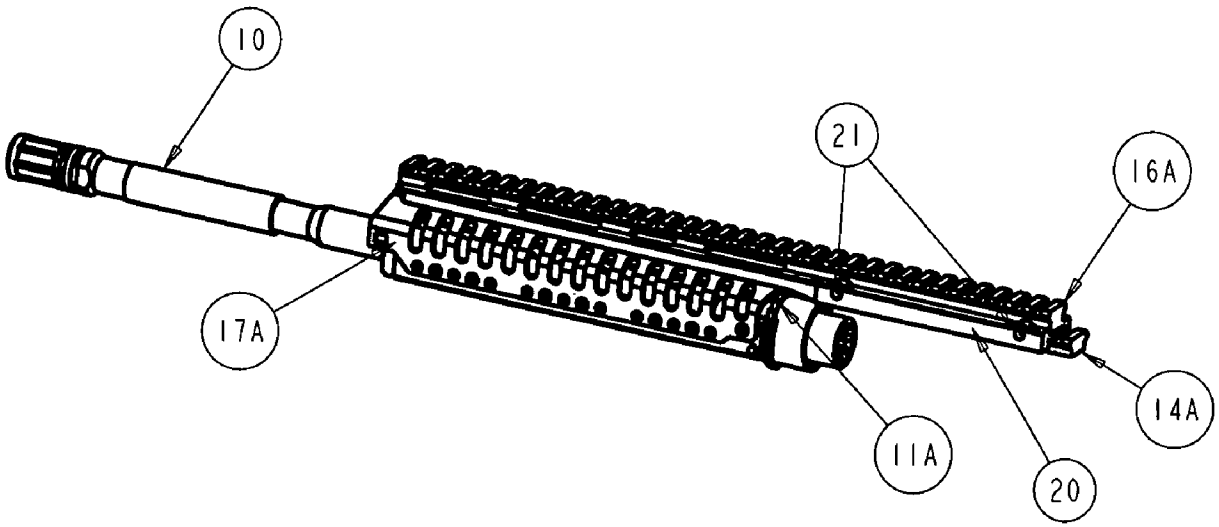
FIG. 2 is a side view of the preferred embodiment after engaging the barrel nut.

FIG. 2 is a side view of the preferred embodiment after engaging barrel nut 11A.

Once the operation outlined in FIG. 1 has been completed, side rail 20 is positioned and secured to an opposing side of top rail 16A using bolts 21. This "squeezing" of the side rail 20 to sandwich the receiver rail 14A with the top rail 16A provides an extremely secure locking mechanism which does not permit "wobble" or a loose fit.

In this manner, upper portion 17A of the shield is secured to the barrel nut 11A and to the receiving rail 14A. This also positions top portion 17A of the shield around barrel 10.

Figure 3:
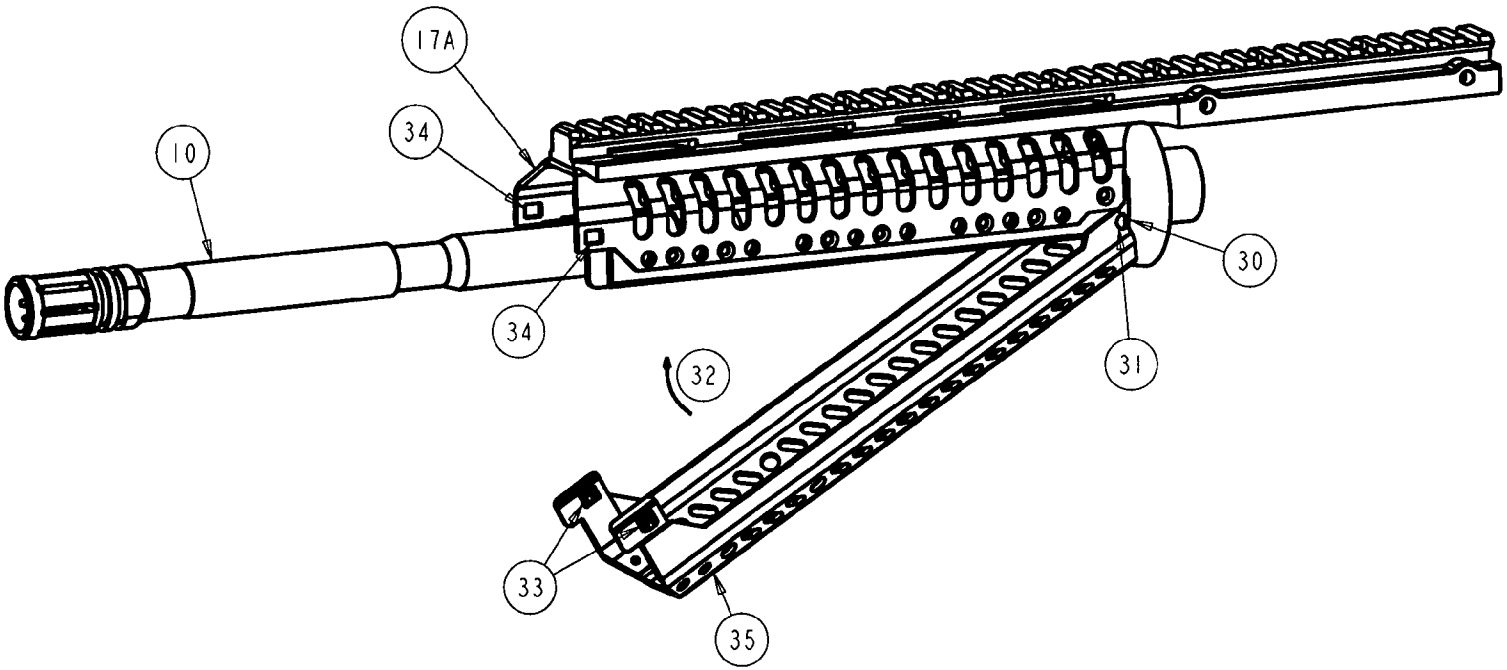
FIG. 3 illustrates the swivel connection between the upper portion of the shield and the lower portion of the shield.

FIG. 3 illustrates the swivel connection between the upper portion of the shield and the lower portion of the shield.

When the top portion 17A of the shield has been secured to the firearm (illustrated in FIGS. 1 and 2), the bottom portion 35 engages the top portion of the shield using slot 31 (an associated slot is located on the opposing side of top portion 17 and is not visible from this angle) which swivelly engages pin 30 (another pin is located on the opposing side). Bottom portion 35 of the shield is rotated as indicated by arrow 32 so that spring snaps 33 engage slots 34 to firmly secure the bottom portion 35 to the top portion of the barrel handguard, thereby creating a shield which completely surrounds a portion of barrel 10.

FIG. 4*a* is a front perspective of the fully assembled shield of the preferred embodiment encircling the barrel; FIG. 4B is a rear perspective of the fully assembled shield of the preferred embodiment encircling the barrel.

Lower portion 35A and upper potion 17A enclose and protect barrel 10. Upper portion 17A is secured to the weapon via barrel nut 11A and top rail 16A. Top rail 16A is secured to the weapons receiver rail (not shown) using side rail 20.

It is clear the present invention provides for a highly improved rail system.

What is claimed is:

1. An attachment for a firearm having a barrel with a barrel nut mechanism located around an aft portion of said barrel, said attachment comprising:

a) a supplemental mechanism adapted to be positioned proximate to said barrel;

b) an attachment mechanism secured to said supplemental mechanism having a first and second claw diametrically opposed to each other and positioned to be accepted by said barrel nut mechanism;

c) a barrel handguard completely surrounding a portion of said barrel and having, 1) an upper portion permanently attached to said attachment mechanism, and, 2) a lower portion swivelly connected to said attachment mechanism at a first end thereof and having a locking mechanism at an opposing second end, said locking mechanism selectively engaging said upper portion;

d) an attachment rail;

e) a rail mechanism secured to said upper portion of the barrel handguard and secureable to the attachment rail;

f) a side rail engaging said rail mechanism and the attachment rail; and, g) a compression mechanism compressing said side rail against both said rail mechanism and the attachment rail.

2. The attachment for a firearm according to claim 1, wherein said lower portion of the barrel handguard is removable from said attachment mechanism.

3. The attachment for a firearm according to claim 1, wherein said locking mechanism includes a spring mechanism secured to said lower portion of the barrel handguard and engagable with holes in said upper portion of the barrel handguard.

4. A mechanism for a firearm having a barrel with a barrel nut mechanism located around an aft portion of said barrel, said mechanism including:

a) an attachment mechanism having a first and second claw diametrically opposed to each other and positioned to be accepted by said barrel nut mechanism;

b) an attachment rail;

c) a rail mechanism;

d) a side rail-which engages said rail mechanism and the attachment rail; and, e) a compression mechanism compressing said side rail against both said rail mechanism and the attachment rail.

5. The mechanism for a firearm according to claim 4, further including a supplemental mechanism adapted to be positioned proximate to said barrel, and secured to said attachment mechanism.

6. The mechanism for a firearm according to claim 4, wherein said supplemental mechanism includes a barrel handguard completely surrounding a portion of said barrel.

7. The mechanism for a firearm according to claim 6, wherein said barrel handguard includes:

a) an upper portion permanently attached to said attachment mechanism; and, b) a lower portion secureable to said upper portion of the barrel handguard.

8. The mechanism for a firearm according to claim 7, wherein said lower portion of the barrel handguard is:

a) swivelly connected to said attachment mechanism at a first end thereof; and, b) includes a locking mechanism at an opposing second end, said locking mechanism selectively engaging said upper portion of the barrel handguard.

9. The mechanism for a firearm according to claim 8, wherein said locking mechanism includes a spring mechanism secured to said lower portion of the barrel handguard and engagable with holes in said upper portion of the barrel handguard.

10. The mechanism for a firearm according to claim 7, wherein said lower portion of the barrel handguard is removable from said attachment mechanism.

11. The mechanism for a firearm according to claim 7, a) wherein said firearm includes an attachment rail; and, b) further including a rail mechanism secured to said upper portion and secureable to a top of said attachment rail.

12. An auxiliary attachment for a firearm having a barrel, and a barrel nut mechanism connecting an aft portion of said barrel, said auxiliary attachment comprising:

a) a barrel handguard completely surrounding a portion of said barrel when installed on said firearm;

b) an attachment mechanism secured to said barrel handguard and having a first and second claw diametrically opposed to each other and positioned to be accepted by said barrel nut mechanism;

c) an attachment rail;

d) a rail mechanism;

e) a side rail which engages said rail mechanism and the attachment rail; and, f) a compression mechanism compressing said side rail against both said rail mechanism and the attachment rail.

13. The auxiliary attachment for a firearm according to claim 12, wherein said barrel handguard includes:

a) an upper portion permanently attached to said attachment mechanism; and, b) a lower portion connectable to said attachment mechanism at a first end thereof and connectable to the upper portion of the barrel handguard at an opposing second end.

14. The auxiliary attachment for a firearm according to claim 13, wherein said lower portion of the barrel handguard is swivelly connected at the first end thereof to the attachment mechanism.

15. The auxiliary attachment for a firearm according to claim 14, wherein said lower portion of the barrel handguard includes a locking mechanism at the second end thereof, said locking mechanism adapted to selectively engage said upper portion of the barrel handguard.

16. The auxiliary attachment for a firearm according to claim 15, wherein said lower portion of the barrel handguard is removable from said attachment mechanism.

17. The auxiliary attachment for a firearm according to claim 15, wherein said locking mechanism includes a spring mechanism secured to said lower portion of the barrel handguard and engagable with slots in said upper portion of the barrel handguard.

* * * * *

UNITED STATES PATENT AND TRADEMARK OFFICE

CERTIFICATE OF CORRECTION

PATENT NO. : 7,059,076 B2
APPLICATION NO. : 10/877426
DATED : June 13, 2006
INVENTOR(S) : Stoner et al.

It is certified that error appears in the above-identified patent and that said Letters Patent is hereby corrected as shown below:

On the Title Page, Item (75), Inventors: "Gregg T. Mott"

should read --Greg T. Mott--.

Signed and Sealed this

Seventeenth Day of October, 2006

JON W. DUDAS
*Director of the United States Patent and Trademark Office*

US007059076C1

(12) EX PARTE REEXAMINATION CERTIFICATE (8221st)

United States Patent
Stoner et al.

(10) Number: US 7,059,076 C1
(45) Certificate Issued: May 10, 2011

(54) FIREARM RAIL SYSTEM

(76) Inventors: Matthew J Stoner, Tucson, AZ (US); Cade L. Wilson, Tucson, AZ (US); Gustavo T. Palacios, Tucson, AZ (US); Jeffrey W. Henderson, Tucson, AZ (US); Greg T. Mott, Tucson, AZ (US)

Reexamination Request:
No. 90/010,272, Sep. 8, 2008

Reexamination Certificate for:

| | |
|---|---|
| Patent No.: | **7,059,076** |
| Issued: | **Jun. 13, 2006** |
| Appl. No.: | **10/877,426** |
| Filed: | **Jun. 25, 2004** |

Certificate of Correction issued Oct. 17, 2006.

(51) Int. Cl.
*F41A 21/48* (2006.01)

(52) U.S. Cl. ..... 42/75.01; 42/75.02; 42/96
(58) Field of Classification Search ..... None
See application file for complete search history.

(56) References Cited

U.S. PATENT DOCUMENTS

| | | | | | |
|---|---|---|---|---|---|
| 5,590,484 | A | * | 1/1997 | Mooney et al. | 42/111 |
| 6,499,245 | B1 | * | 12/2002 | Swan | 42/1.01 |
| 6,792,711 | B2 | * | 9/2004 | Battaglia | 42/114 |
| 6,854,206 | B2 | * | 2/2005 | Oz | 42/124 |

* cited by examiner

*Primary Examiner*—Jeffrey R. Jastrzab

(57) ABSTRACT

An attachment for a firearm having a barrel with a barrel nut mechanism located around an aft portion of said barrel. The attachment includes a shield or supplemental mechanism which is positioned close to the barrel. An attachment mechanism having a first and second claw diametrically opposed to each other, are positioned to be accepted by the barrel nut mechanism secured to the barrel. In the preferred embodiment, the attachment completely encircles the barrel using an upper portion and a lower portion which is swivelly connected to said attachment mechanism at a first end and a locking mechanism securable to the upper portion of the barrel handguard.

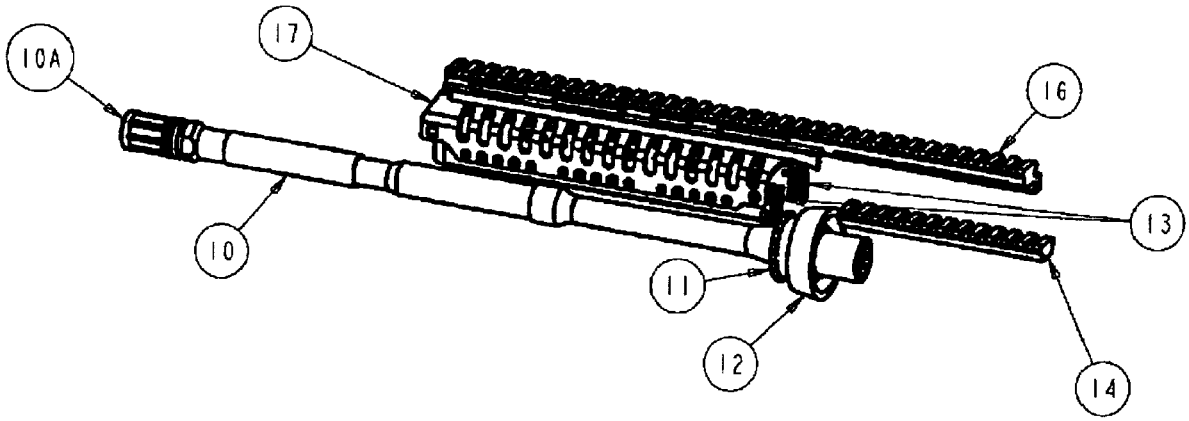

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-3 is confirmed.

Claims 6-8, 10, 13 and 14 are cancelled.

Claims 4, 9, 11, 12 and 15 are determined to be patentable as amended.

Claims 5, 16 and 17, dependednt on an amended claim, are determined to be patentable.

4. A mechanism for a firearm having abarrel with a barrel nut mechanism located around an aft portion of said barrel, said mechanism including:

a) an attachment mechanism having a first and second claw diametrically opposed to each other and positioned to be accepted by said barrel nut mechanism;

b) an attachment rail;

c) a rail mechanism;

d) a side rail which engages said rail mechanism and the attachment rail; [and,]

e) a compression mechanism compressing said side rail against both said rail mechanism and the attachment rail*; and,*

*f) a barrel handguard completely surrounding a portion of said barrel, said barrel handguard having an upper portion permanently attached to said attachment mechanism and, a lower portion securable to said upper portion of the barrel handguard, said lower portion being swivelly connected to said attachment mechanism at a first end thereof and a locking mechanism at an opposing second end, said locking mechanism selectively engaging said upper portion of the barrel handguard.*

9. The mechanism for a firearm according to claim [8] *5*, wherein said locking mechanism includes a spring mechanism secured to said lower portion of the barrel handguard and engagable with holes in said upper portion of the barrel handguard.

11. The mechanism for a firearm according to claim [7] *5*, a) wherein said firearm includes an attachment rail; and, b) further including a rail mechanism secured to a top of said attachment rail.

12. An auxiliary attachment for a firearm having a barrel, and a barrel nut mechanism connecting an aft portion of said barrel, said auxiliary attachment comprising:

a) a barrel handguard completely surrounding a portion of said barrel when installed on said firearm*, said handguard having an upper portion permanently attached to said attachment mechanism and a lower portion swivelly connectable to said attachment mechanism at a first end thereof and connectable to the upper portion of the barrel handguard at an opposing second end*;

b) an attachment mechanism secured to said barrel handguard and having a first and second claw diametrically opposed to each other and positioned to be accepted by said barrel nut mechanism;

c) an attachment rail;

d) a rail mechanism;

e) a side rail which engages said rail mechanism and the attachment rail; and, f) a compression mechanism compressing said side rail against both said rail mechanism and the attachment rail.

15. The auxiliary attachment for a firearm according to claim [14] *12*, wherein said lower portion of the barrel handguard includes a locking mechanism at the second end thereof, said locking mechanism adapted to selectively engage said upper portion of the barrel handguard.

* * * * *